US009146082B2

(12) United States Patent
Graham et al.

(10) Patent No.: US 9,146,082 B2
(45) Date of Patent: Sep. 29, 2015

(54) INTELLIGENT BALLISTIC TARGET

(71) Applicants: Sam D. Graham, Manakin Sabot, VA (US); Scott Staylor, Bumpass, VA (US)

(72) Inventors: Sam D. Graham, Manakin Sabot, VA (US); Scott Staylor, Bumpass, VA (US)

( * ) Notice: Subject to any disclaimer, the term of this patent is extended or adjusted under 35 U.S.C. 154(b) by 186 days.

(21) Appl. No.: 13/708,103

(22) Filed: Dec. 7, 2012

(65) Prior Publication Data

US 2013/0147117 A1 Jun. 13, 2013

Related U.S. Application Data

(60) Provisional application No. 61/568,257, filed on Dec. 8, 2012.

(51) Int. Cl.
*F41J 5/052* (2006.01)
*F41J 7/04* (2006.01)

(52) U.S. Cl.
CPC ..... *F41J 7/04* (2013.01)

(58) Field of Classification Search
USPC ..... 273/371–378, 383–386, 393, 403–408; 463/2
See application file for complete search history.

(56) References Cited

U.S. PATENT DOCUMENTS

| | | | | | |
|---|---|---|---|---|---|
| 741,131 | A * | 10/1903 | Hanson | 273/385 |
| 1,337,932 | A * | 4/1920 | McClellan et al. | 273/385 |
| 1,341,814 | A * | 6/1920 | Mosby | 273/385 |
| 1,413,770 | A * | 4/1922 | Palaith | 273/384 |
| 1,832,711 | A * | 11/1931 | Jeckert | 273/374 |
| 3,008,714 | A * | 11/1961 | Pullen | 273/393 |
| 3,233,904 | A * | 2/1966 | Gillam et al. | 273/371 |
| 4,090,714 | A | 5/1978 | Izushi | |
| 4,222,564 | A | 9/1980 | Allen et al. | |
| 4,437,671 | A * | 3/1984 | Busch | 273/372 |
| 4,662,845 | A * | 5/1987 | Gallagher et al. | 434/22 |
| 4,934,937 | A * | 6/1990 | Judd | 434/21 |
| 4,974,833 | A * | 12/1990 | Hartman et al. | 482/3 |
| 5,222,741 | A * | 6/1993 | Redl | 273/393 |
| 5,403,017 | A * | 4/1995 | Doss et al. | 273/372 |
| 5,518,251 | A * | 5/1996 | Liu | 273/371 |
| 8,162,319 | B2 * | 4/2012 | Stincelli et al. | 273/406 |
| 8,561,993 | B2 * | 10/2013 | Preston et al. | 273/372 |
| 8,757,627 | B1 * | 6/2014 | Sedlacek | 273/407 |
| 2009/0102129 | A1 * | 4/2009 | Isoz et al. | 273/372 |
| 2009/0194943 | A1 * | 8/2009 | Amitai et al. | 273/373 |

FOREIGN PATENT DOCUMENTS

| | | | |
|---|---|---|---|
| EP | 676612 | A1 | 10/1995 |
| EP | 2290315 | A4 | 1/2013 |
| WO | WO0190675 | A3 | 4/2002 |

OTHER PUBLICATIONS

International Search Report mailed Aug. 21, 2013, which issued in corresponding International Application No: PCT/US2012/068446.

* cited by examiner

*Primary Examiner* — Mark Graham
(74) *Attorney, Agent, or Firm* — Fish & Richardson P.C.

(57) ABSTRACT

An intelligent target comprising a target body suspended from a support structure, at least one sensor affixed to the target body that detects a hit in an area of the target body, a controller, in communication with each sensor, that records the hits detected by the sensor and the area of the target body that was hit and issues a release command when a predetermined number of hits has been reached, and a release mechanism operatively connected with the controller and which releases the target body and allows the body to fall from the support structure on receipt of the release command from the controller.

27 Claims, 10 Drawing Sheets

INTELLIGENT BALLISTIC TARGET

CROSS REFERENCE TO RELATED APPLICATIONS

This application claims priority from U.S. Provisional Application Ser. No. 61/568,257, filed on Dec. 8, 2011, which is incorporated herein by reference in its entirety.

FIELD OF THE INVENTION

This invention relates to an intelligent target for use in competitive sports shooting and also for training military and law enforcement personnel.

BACKGROUND OF THE INVENTION

Targets for use in competitive shooting sports and in training law enforcement and military personnel are generally static devices consisting of paper, cardboard or steel. Although these targets may have a generally human form, no feedback is provided to the trainee or competitor in terms of whether the projectile "strike" on the target is more or less valuable for the purposes of disabling or immobilizing the target. This is of particular importance in the training of military and law enforcement personnel. Police and military personnel are generally trained to aim for the "Center Of Mass" (COM), referring to the largest target area (the upper chest and torso area of the human body). However shots to the head are more likely to disable or immobilize an armed adversary. For this reason, static targets do not reflect the situations encountered in real life firefights. In these situations the value of a strike to the adversary's head is more likely to disable or immobilize the target than two or more shots that impact the COM. Present targets do not distinguish between a hit to the head or to the COM and do not offer immediate "real-time" performance feedback.

A problem in training law enforcement and military personnel at a shooting range is that the trainees will frequently fall into routines of firing one or two shots at the target and then discontinuing fire. This routine can be dangerous as it does not reflect real life encounters with armed adversaries. There are reported instances of law enforcement officers being shot because they were programmed to fire two shots and then discontinue firing, as opposed to continuing to fire until the target was immobilized.

Further, current targets generally have a COM target of about six inches in diameter and a head target represented by a three inch by two inch rectangle and a hit to each area is weighted the same for scoring. In real life encounters, a shot striking the head is more difficult, but is more likely to disable the target.

What is needed is a target that provides feedback to the trainee or competitor with respect to the number of hits to the target and the value (in terms of disabling or immobilizing the target) of each hit. The present invention overcomes these drawbacks of existing target structures and devices and provides an interactive target that provides real-time performance feedback to the shooter.

SUMMARY OF THE INVENTION

It is an object of the present invention to provide an interactive ballistic target that provides real time shooting performance feedback to the shooter.

The interactive ballistic target of the present invention constitutes a target body having generally human form. The target is releasably suspended in the upright (standing or kneeling) position from an adjustable height support and has at least two sensors that detect shooting impact and send a signal (that includes information on the location of the impact on the target body, and also on the number of impacts (projectile strikes or hits)) to a processor or controller located in the interior of the target body. The controller records the number of "hits", the location of each hit, weighs each "hit" for its disabling value (which may be accomplished by according a different weight to a hit on a particular area of the target, such as the head), and generates a random number of hits that must be exceeded for the controller to signal a target release device to drop the target (to simulate disabling an adversary).

Another embodiment of the invention includes apparatus for automatically resetting the target body into the erect (or kneeling) shooting position.

In another embodiment the target body is surrounded by a skin.

In a still further embodiment the target body comprises a skin made of a material that prevents or reduces ricochets.

In yet another embodiment, the target is made of modular components that can easily be replaced.

The invention will be better understood by reference to the accompanying drawings.

DETAILED DESCRIPTION OF THE INVENTION

Figure 1:
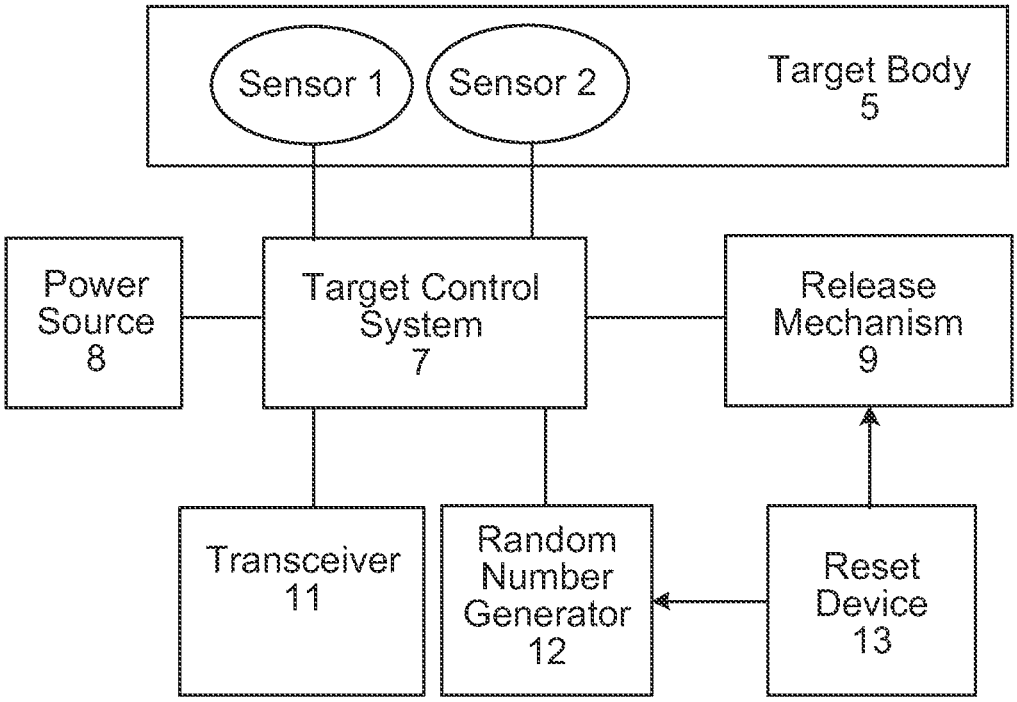
FIG. 1 is a schematic drawing of the target control system for a ballistic compliance target of the present invention.

The present invention provides a realistic ballistic compliance target for use inter alia in competitive shooting sports and in training military and law enforcement personnel. The ballistic compliance target includes a target body with an electronic system for detecting "hits" to vital areas of the target, a target support frame from which the target body is suspended, and one or more control systems for processing "hit" information. The control systems may be on-board and within the target body, or within or otherwise attached to a target support frame.

Generally, embodiments of the ballistic compliance target are of one of two forms, a "manual" target and an "automatic" target.

In both "manual" and "automatic" embodiments, the target body is suspended on a target support frame by a release mechanism, which may be a latch mechanism, a peg mechanism, an elastic mechanism, a winch-type mechanism, that may include a manual winch, or a recovery mechanism driven by an electric motor, an pneumatic engine, a gasoline powered engine, a diesel powered engine, an equivalent driving device or a combination thereof. The target body includes electronic sensors in one or more regions such as the head, the Center of Mass (COM), the spine, and other regions simulating vital target areas that send a signal to one or more control systems when the respective areas of the target are struck by a projectile or other energy discharged from a firearm, rifle, or other such device. The control system counts the number of projectile or energy strikes on the vital target areas, accords differential weight to each of the sites of the impact and generates a random "hit" number that must be exceeded in order to release the target from its upright supported position and allow it to fall, simulating the disablement of an adversary.

The ballistic compliance target of the present invention counts the number of projectile or other energy strikes to the target body ("hits"). When the target body is struck by a projectile, such as a bullet, a less powerful target round, a pellet, buckshot, an arrow, a spear, a knife, or a ball, or another energy source, such as a light beam or a laser beam, a sensor located on the target body in the vicinity of the hit sends a signal to a control system. The control system has a random number generator that actuates a release mechanism when the signals for a predetermined number (generated by the random number generator) of hits have been counted. Actuation of the release mechanism releases or lowers the target body from its support and the target body falls from the "upright" (suspended) position to a "dropped" position.

In the "manual" embodiment, the target body may reset from the "dropped" position back to the "upright" position by a user physically resetting the target body on the release mechanism such that it is resuspended on the target support frame. This can be done using a manually operated winch to lift the target body back onto the support frame. The user may also reset the control system such that the counter is cleared and a new random number is generated.

In the "automatic" embodiments, the target body may be lifted from the "dropped" position back to the "upright" position after a pre-determined amount of time through an automatic lifting mechanism, such that the target body may be cycled and repeatedly used as an active shooting target. After each cycle, the control system may automatically reset, such that a new counter and new random number is generated.

In some embodiments, input from each sensor can be differentially weighted so that the signal from one sensor has a higher value than the signal from another sensor. This arrangement permits signals from a particular sensor deployed in the target body, such as one located in the head, spine, or other particularly critical area, to be given a higher value than signals from a sensor located in the COM, to more accurately simulate specific vulnerabilities of an adversary. In some embodiments, signals from sensors deployed in the target body in less critical areas, such as the arms and legs, may be given a higher value than other signals to encourage alternative target disablement techniques.

Figure 2:
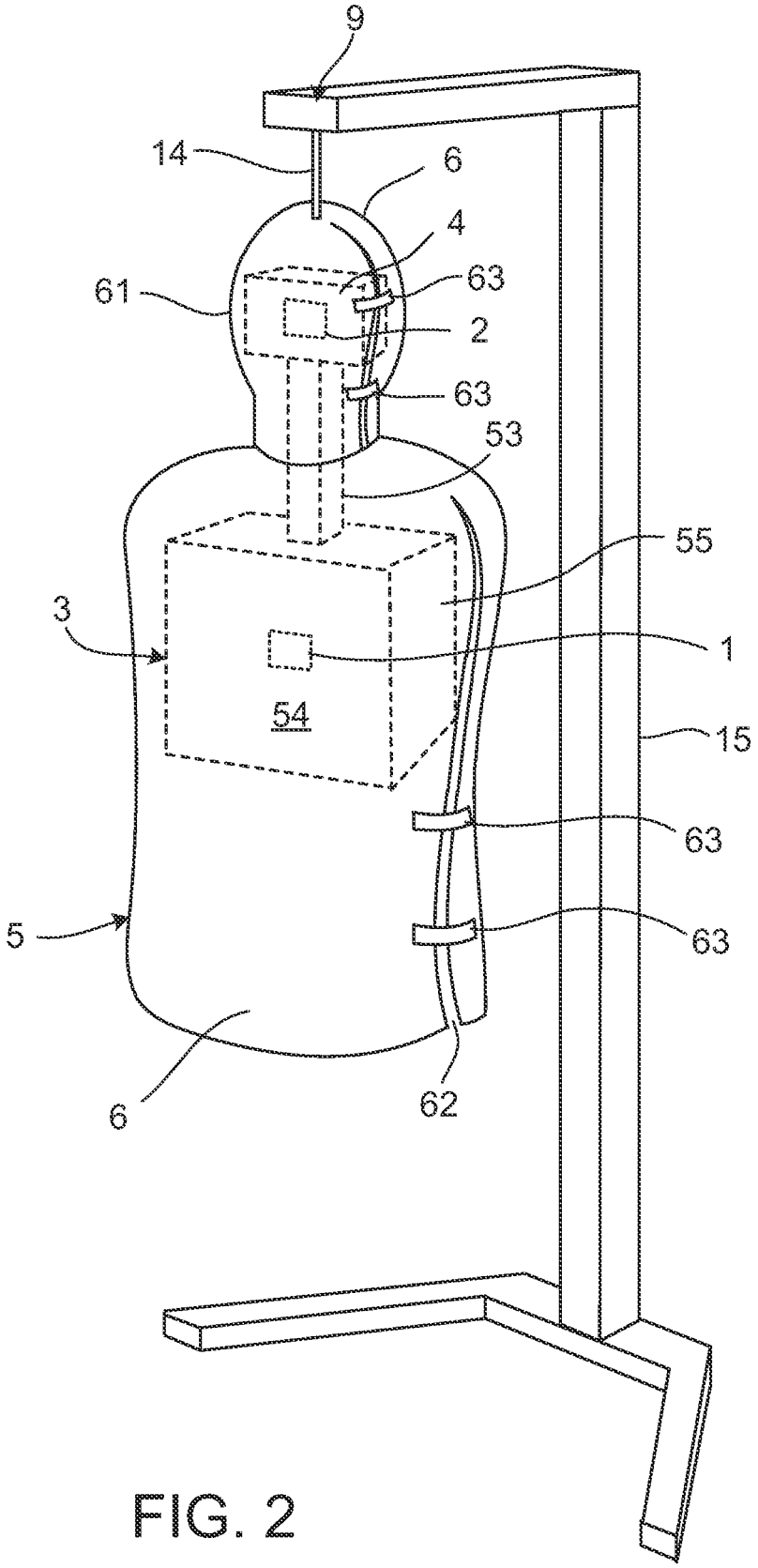
FIG. 2 is a perspective view of the target body of the present invention in its upright supported position.
Figure 3:
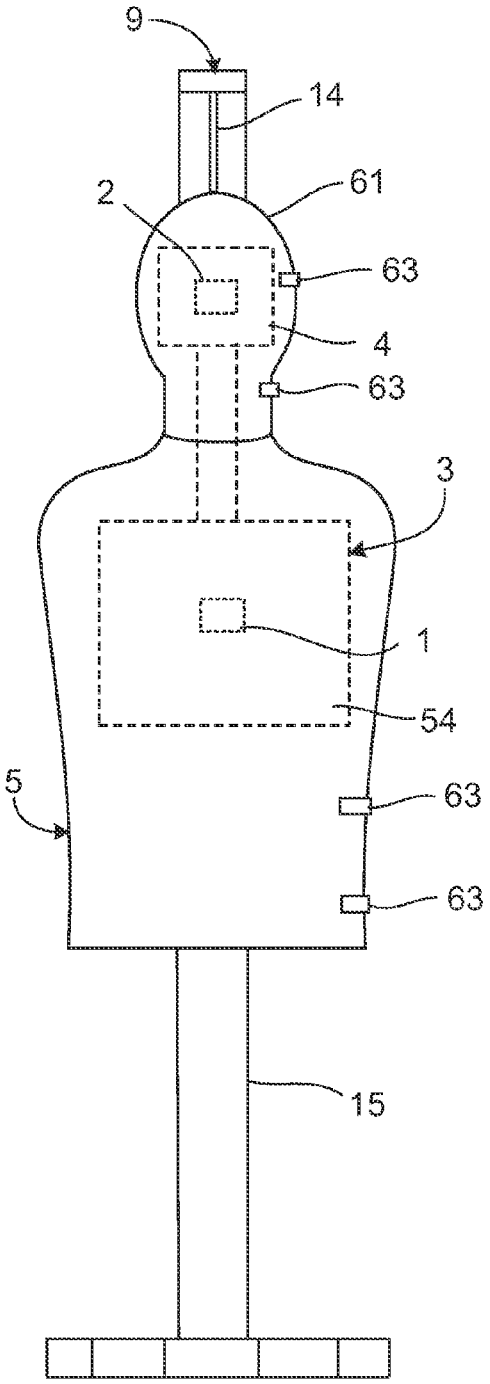
FIG. 3 is a front view of the target body of the present invention that depicts the containers for the head and COM of the target body.
Figure 4:
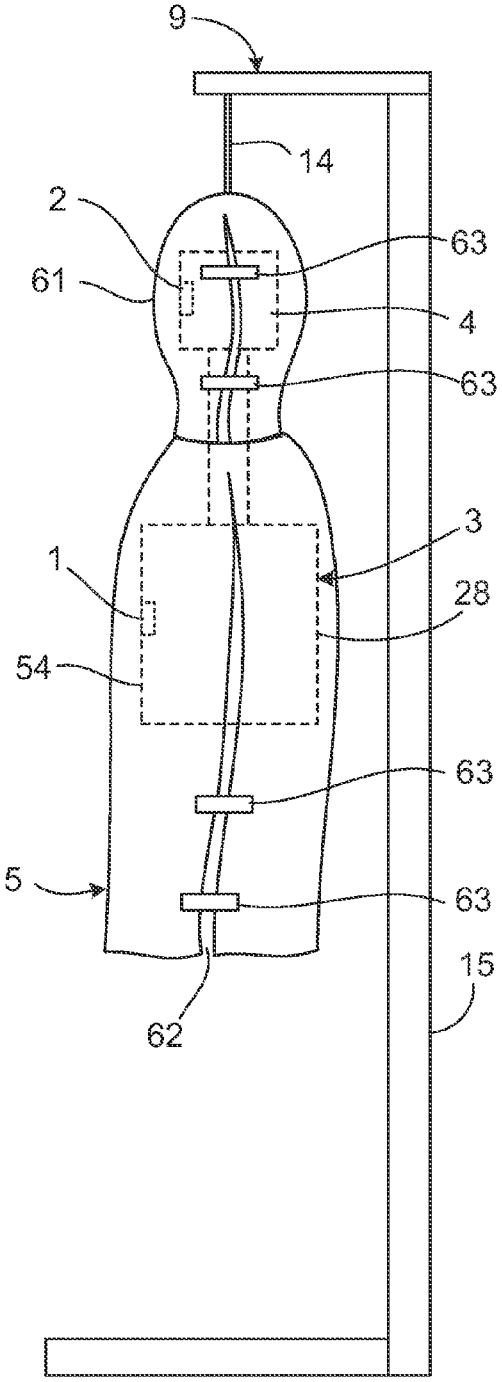
FIG. 4 is a left side view of the target body shown in FIG. 3.

Referring to the drawings in detail, FIG. 1 is a schematic illustration of an exemplary system for electronic control and operation of the ballistic compliance target of the present invention. FIGS. 2, 3, and 4 illustrate a perspective view, a front view, and a side view of an exemplary ballistic compliance target, respectively. Sensors 1 and 2 are respectively mounted in the interior of the container 3 for the COM of the target body and inside the head container 4. The sensors detect the impact of a projectile (or other energy source) on the target body 5 in the vicinity of the sensor. Sensors 1 and 2 may operate by mechanical pressure, sound detection, vibration detection, acceleration detection, or via detection of optical signals. Vibration detecting sensors are one preferred embodiment of the invention. Such sensor devices are widely available through commercial sources and are well known to those skilled in the art. Light or laser sensors are mounted outside target body 5. In those embodiments in which light beams are used to simulate projectiles, the sensors 1 and 2 are optical sensors and are mounted on the skin 6 of target body 5 respectively in the vicinity of the head container 4 and the COM container 3. In some embodiments, sensors 1 and 2 may be piezo-electric sensors that measure the frequency and amplitude of localized vibrations. In these embodiments, sensors 1 and 2 may detect one or more harmonic vibration signatures specific to particular portions of target body 5 as they are hit by projectiles. By analyzing the frequency and amplitude of the vibrations, the impact location and the strength of a projectile strike can be determined. In these embodiments, sensors 1 and 2 may be located in the COM container 3, in the head container 4, or in any other centrally located portion of target body 5 such that they may detect vibrations originating from any region of target body 5.

The location and number of sensors may be varied to detect the impact of a projectile or other energy source on other regions of target body 5, such as in areas representing the spine, the hands, the arms, or the legs. Power to target control system 7 is provided by operably connected power source 8.

Target body 5 is suspended from target support frame 15 by a cable 14 connected through release mechanism 9. In some embodiments, cable 14 may be an elastic material, a fiber, a wire, or a rope and may lift the target body onto a pin, a peg, or a combination thereof. Release mechanism 9 may be a latch mechanism, a peg mechanism, an elastic mechanism, or a winch-type mechanism, and may be driven by an electric motor, a pneumatic motor, a gasoline powered engine, a diesel powered engine, or an equivalent power source or a combination thereof. Power source 8 may be a battery, an electric generator, or a connector to an external power system, such as a power grid.

Figure 5:
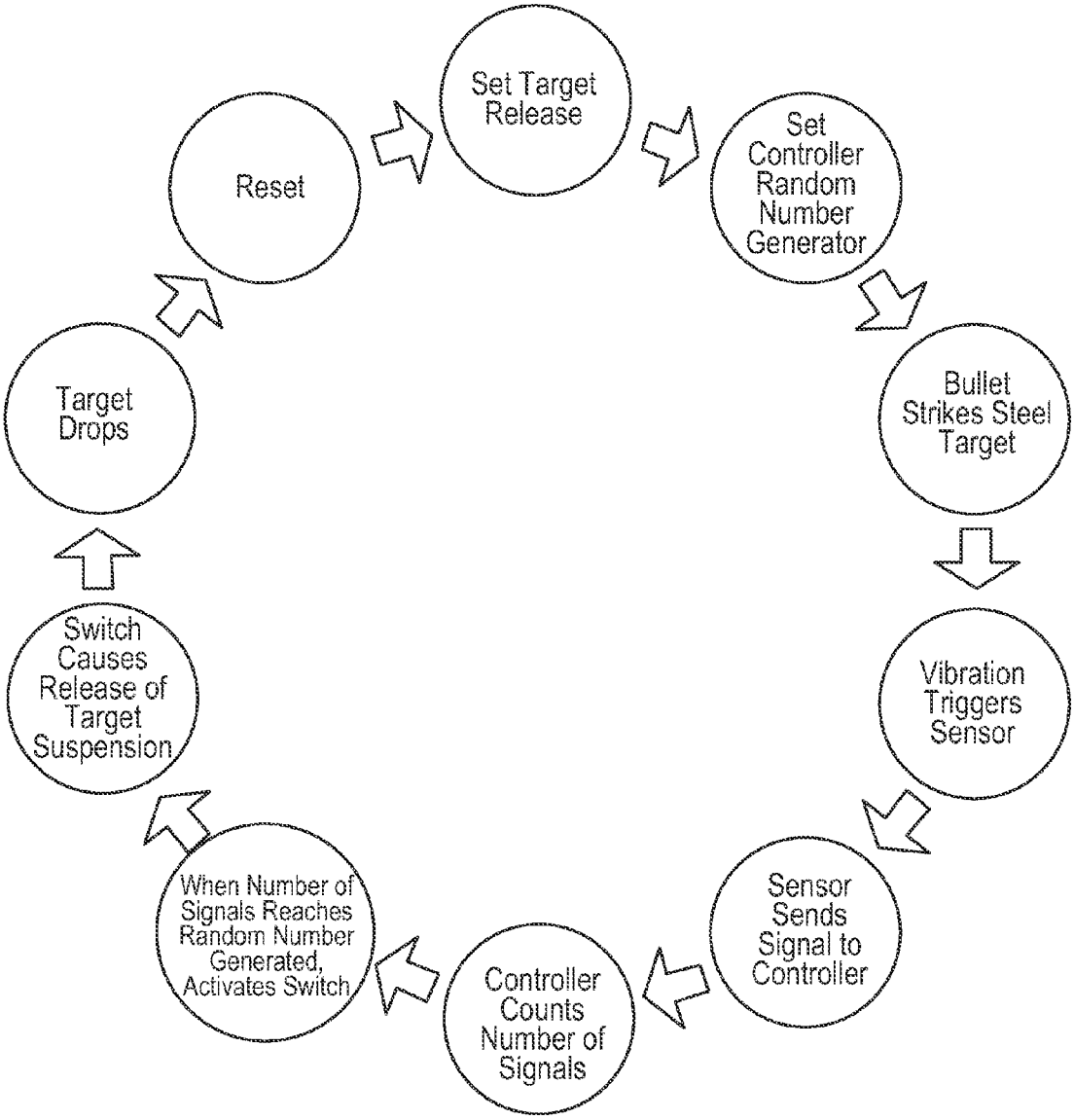
FIG. 5 is a flow chart depicting the sequential steps in the operation of the ballistic compliance target in a "manual" embodiment.

FIG. 5 depicts in stepwise fashion the sequence of operations of a "manual" embodiment of the ballistic compliance target of the present invention. Sensors 1 and 2, located on or within target body 5, communicate the impact information resulting from a projectile or energy striking the target body 5 to target control system 7, which may be a microprocessor or an analog control device, and which counts and records the number of impacts detected by sensors 1 and 2. The sensors 1 and 2 can be hard wired to target control system 7 or can communicate wirelessly via transceiver 11. Transceiver 11 may be or a hard wired or wireless design, or may communicate through a network such as a LAN, WiFi network, Bluetooth network, infrared network, cellular telephone network, or another such network. The target control system 7 communicates with a random number generator circuit 12 and a release mechanism 9 through a resetting device 13 which operates to reset the system for a new round of target shooting. The random number generator 12 randomly selects a number (usually between 1 and 10) and transmits this number to the target control system 7. The transmitted number received by the target control system 7 from the random number generator 12 is used to set the number of hits on the target that must be received by the target control system 7 before it will transmit a release signal to the release mechanism 9. Receipt by the release mechanism 9 of the release signal from the target control system 7 causes the release mechanism 9 to activate a solenoid or semiconductor switch 64 (within release mechanism 9 illustrated in FIGS. 6 and 7) which in turn activates the latch system 65 to release the target body 5 from its suspended (upright) position. The input from each sensor 1 and 2 can be differentially weighted by target control system 7 so that a signal from one sensor is given greater weight than a signal from the other sensor. In this fashion a hit to a sensor 2, for example deployed in the head container 4 (or on the skin 6) of the target body 5, is given a higher value than the signal from a sensor 1, for example located in the COM container 3 or on the skin 6 of the target body 3 in the vicinity of the COM container 3.

Figure 6A:
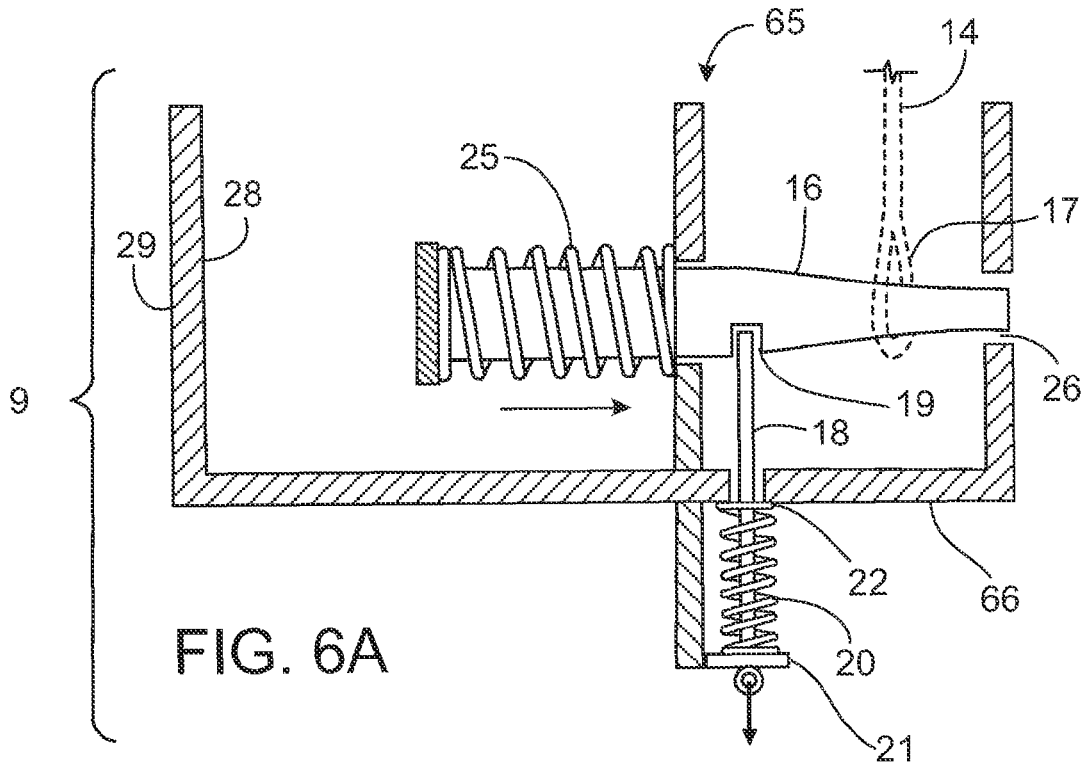
FIG. 6(*a*) illustrates one embodiment of the release pin mechanism for the ballistic compliance target body of the present invention in the locked (target suspended) position and FIG. 6(*b*) illustrates one embodiment of the release pin mechanism for the ballistic compliance target body of the present invention in the open (target released) position.
Figure 6B:
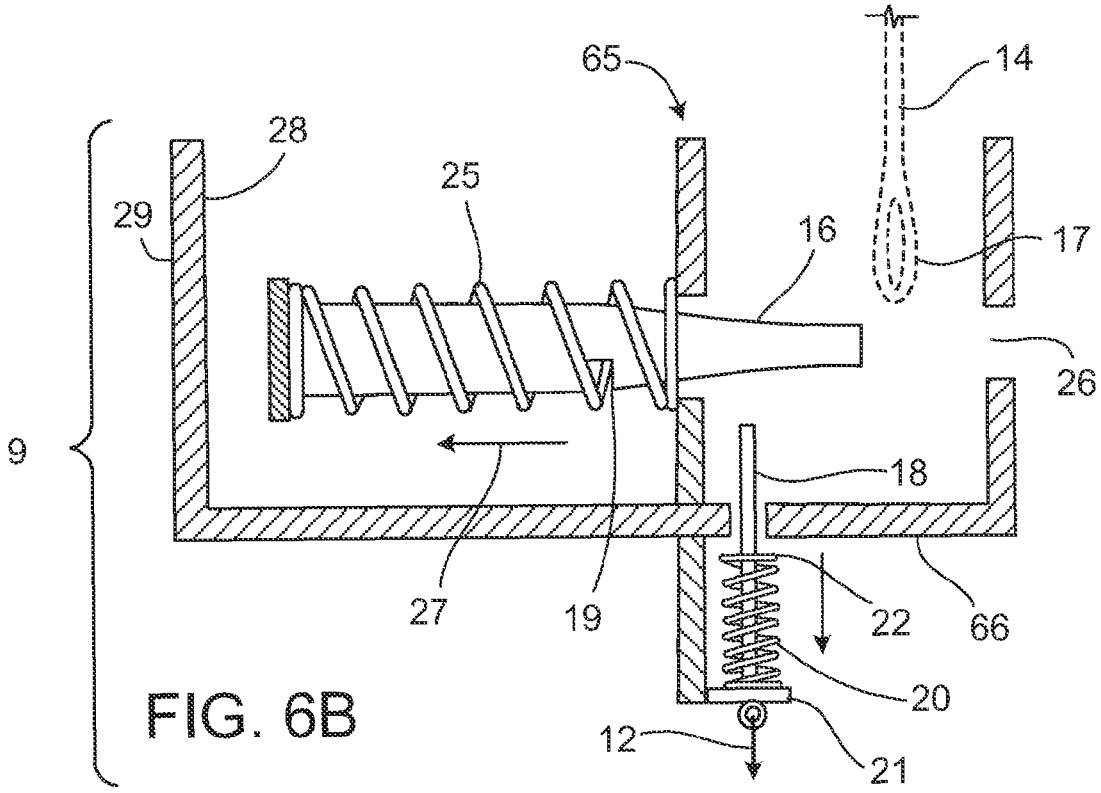
Figure 7:
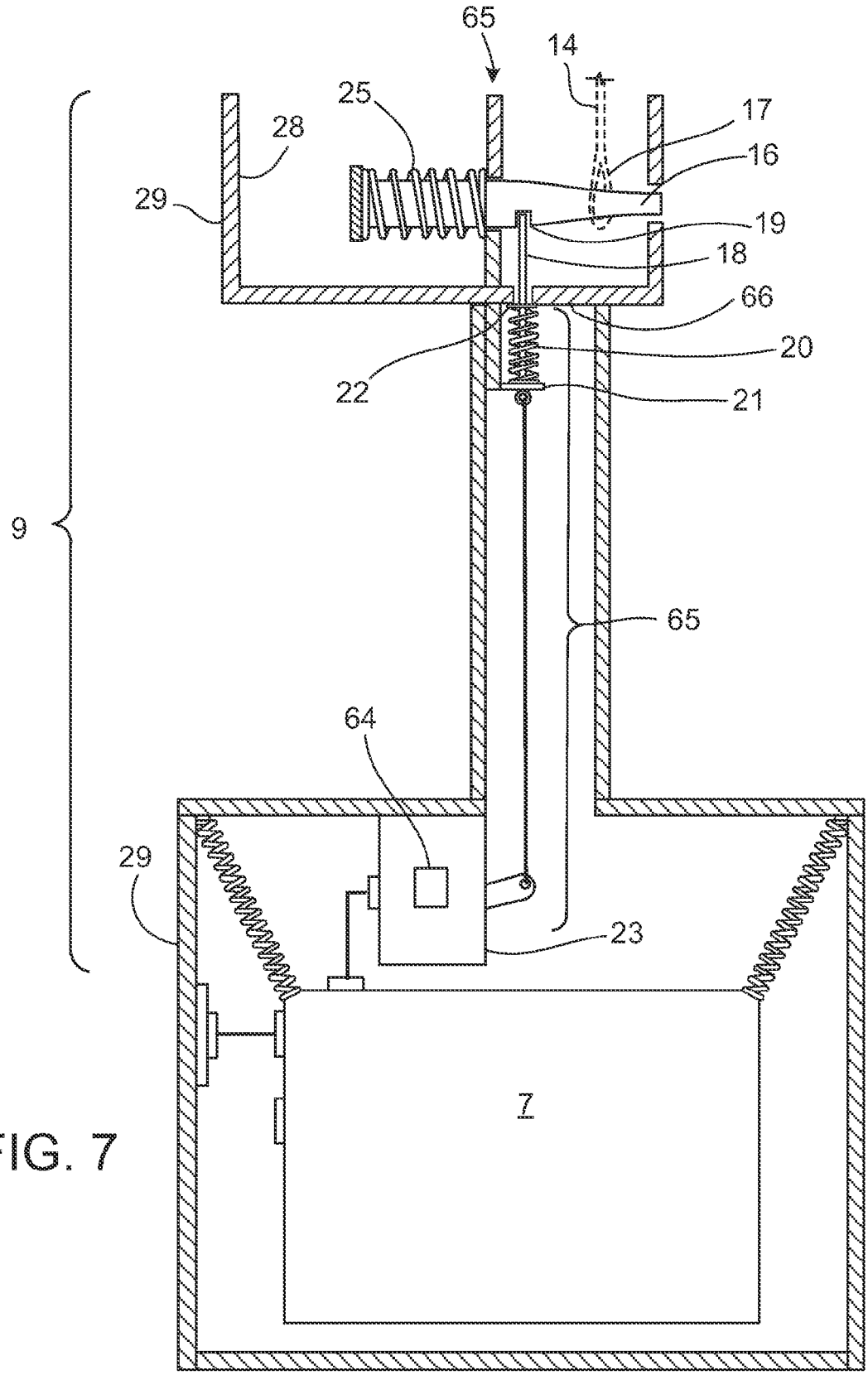
FIG. 7 is a cut-away side view of the target release mechanism of the present invention.

An exemplary release system 9 is illustrated in FIGS. 6 and 7. FIGS. 6 and 7 depict a latch-style release mechanism 9 for releasing the target from the upright position, i.e., target body 5 is supported and held in the upright (standing) position by cable 14 (secured around pin 16 by loop 17) until the number of hits set by the random number generator 12 has been sensed by the target control system 7. Rod 18 is positioned in slot 19 to hold pin 16 in the fixed position against the action of spring 20. Spring 20 is in the relaxed position when rod 18 is inside slot 19. The rod 18 passes through an aperture in bracket 21. The aperture has a larger diameter than rod 18, but a smaller diameter than spring 20. A shoulder 22 is fastened at the upper end of spring 20 and abuts the bottom 66 of housing 29 when spring 20 is extended.

Activation of the switch 23 by target control system 7 withdraws rod 18 in a downward direction from within slot 19 in the body of tapered pin 16 and through the aperture in bracket 21, in the direction of arrow 24 and thereby releases the compression of spring 25 and compresses spring 20 against bracket 21. Tapered pin 16 is also held in position by rod 18 against the action of a spring 25 which is normally compressed (as shown in FIG. 6A). Withdrawal of rod 18 causes pin 16 to be forced backward by the action of spring 25, out of aperture 26 in the direction of arrow 27 and toward the backside 28 of housing 29. Support cable 14, attached to the target body 5, by loop 17 and normally held by pin 16, is then released as loop 17 is slipped off pin 16 by the rearward movement of pin 16 (as shown in FIG. 6B). This action causes the target body 5 which is connected to cable 14 to fall from the upright position, simulating the disablement or immobilization of an armed assailant or adversary.

After rod 18 is withdrawn from slot 19 by activation of solenoid 64, which causes latch 65 to be drawn downward, tapered pin 16 is reset by moving rod 18 into slot 19. Rod 18 moves upward into slot 19 when pin 16 is moved forward to position slot 19 above rod 18. Rod 18 is driven into slot 19 by the action of compressed spring 20. This arrangement enables the target shooter or an assistant to reset the loop 17 in support cable 14 on pin 16 (and move pin 16 forward so that rod 18 engages in slot 19). In this fashion, target body 5 is drawn up by cable 14 and held in the supported upright position for another target shooting round. In the embodiment depicted in FIG. 1, the reset device 13 can be activated manually or automatically. In normal use, the target body 5 is suspended from a flexible cable, wire or cord 7 which is in turn suspended or hung on a target support frame 15. The target body 5 remains in the upright (suspended) position until a release signal has been communicated from the target control system 7 to the release switch 23.

Figure 8A:
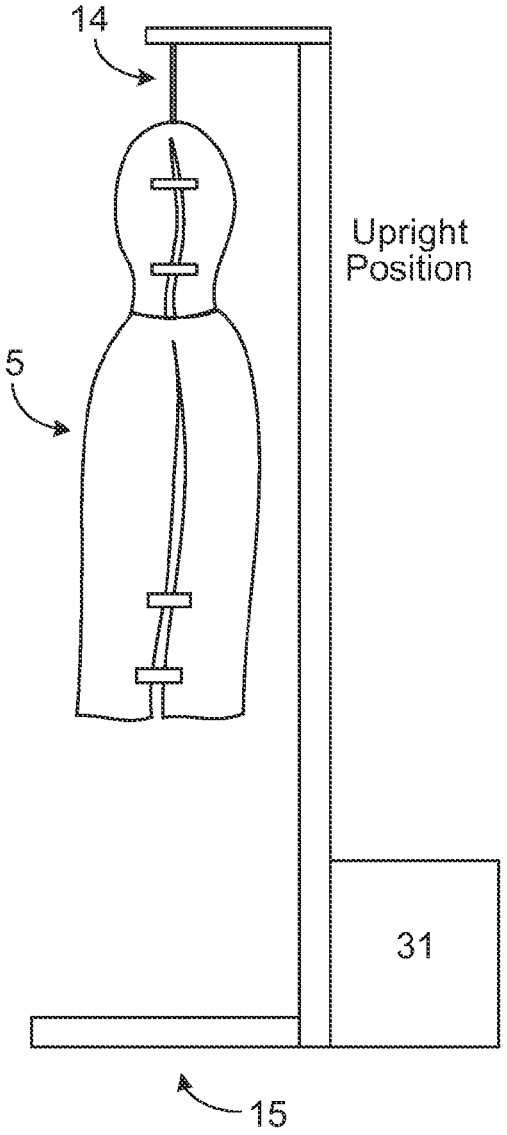
FIG. 8(*a*) is a side view of an "automatic" embodiment of the present invention in its upright supported position FIG. 8(*b*) is a side view of an "automatic" embodiment of the present invention in its dropped position.
Figure 8B:
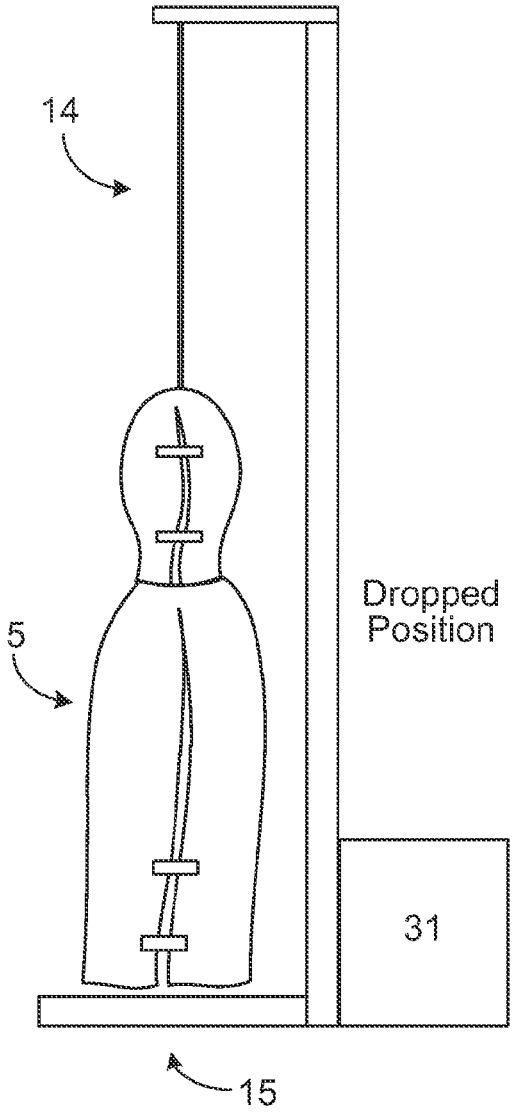
Figure 9:
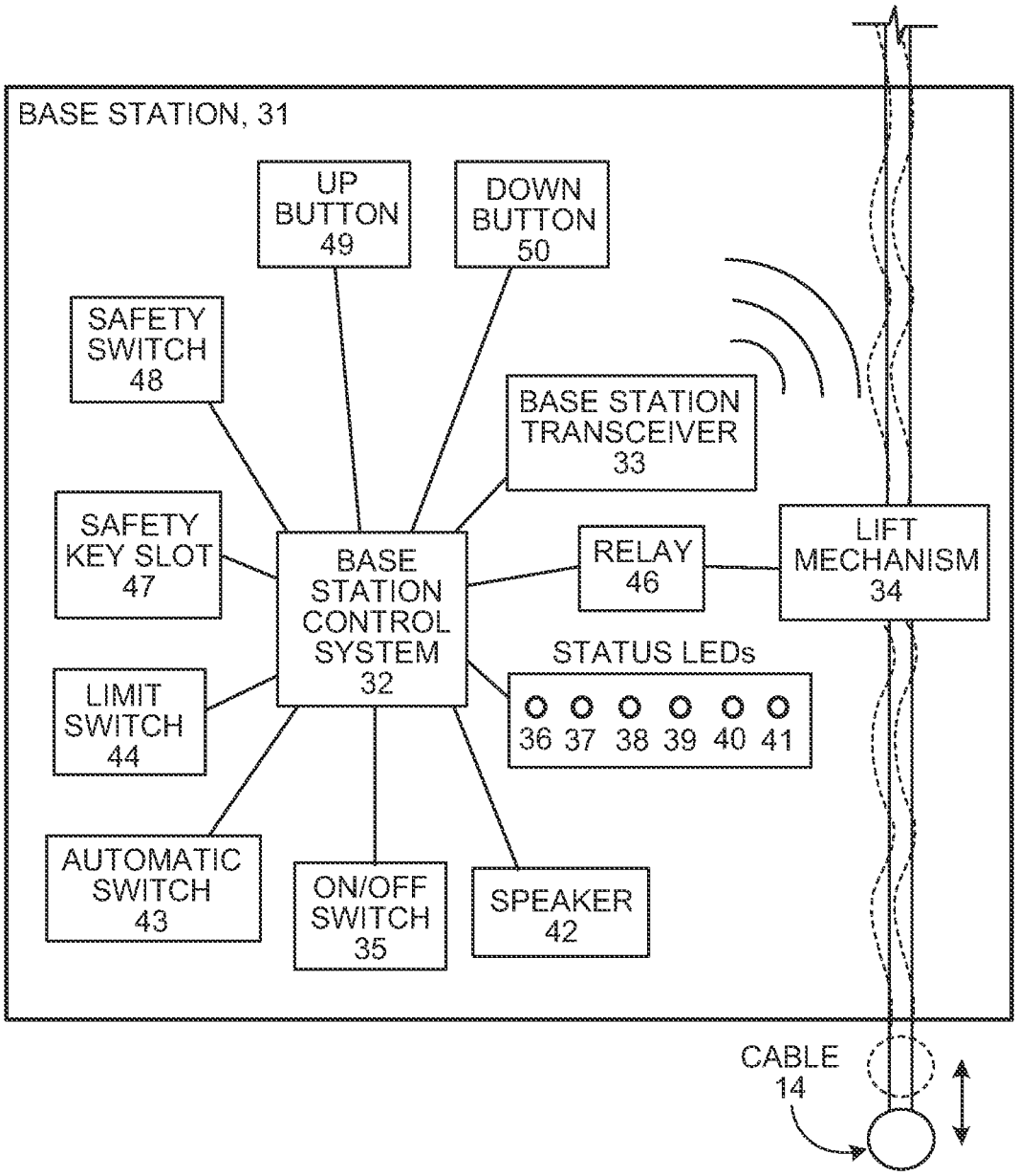
FIG. 9 is a schematic diagram of the base station control system a ballistic compliance target of the present invention.

Referring to FIGS. 8A and 8B, in "automatic" embodiments of the ballistic compliance target, the target body 5 may be alternatively or additionally supported by a base station 31 (shown in more detail in FIG. 9) which will allow the target to be automatically cycled between upright (FIG. 8A) and dropped (FIG. 8B) positions. Referring to FIG. 9, the base station 31 may include base station control system 32, base station transceiver 33, relay 46 connected to a lifting mechanism 34 configured to extend or retract cable 14 supporting target body 5, status light emitting diodes 36, 37, 38, 39, 40, 41, on/off switch 35, automatic switch 43, limit switch 44, safety key slot 47, safety switch 48, "up" button 49, and "down" button 50.

The base station transceiver 33 may be a hardwired or wireless design, and may communicate through a network such as a LAN, WiFi network, Bluetooth network, infrared network, cellular telephone network, or another such network. Base station transceiver 33 may communicate with transceiver 11 to provide data transfer capability between the base station control system 32 and the target control system 7.

Lifting mechanism 34 may be an elastic mechanism, a winch-type mechanism, driven by an electric motor, a pneumatic motor, a gasoline powered engine, a diesel powered engine, an equivalent power source, or a combination thereof. Lifting mechanism 34 may contain one or more spool-like elements in which portions of cable 14 may be wound or released, such that the position of suspended target body 5 may be varied in height.

In some embodiments, base station 31 may be operated in an "automatic" mode such that the target body 5 is reset into an upright position after entering a dropped position for a predetermined amount of time, a "manual" mode such that target body 5 remains in a single position, an emergency stop mode, or a low power "sleep" mode. Physical on/off switch 35 may be used to completely remove power from base station 31. A series of differently colored light emitting diodes may be used to indicate the system's operating mode and power state. For example, if the system is powered, the system "on" LED 36 is illuminated. The operating mode of base station 31 may be indicated by green LED 37 (indicating automatic mode), yellow LED 38 (indicating manual mode), or red LED 39 (indicating emergency stop mode). When communication between the base station control system 32 and the target control system 7 is established via transceivers 33 and 11, the clear LED 40 is illuminated. Any communication between transceiver 33 and 11 causes LED 40 to blink.

In some embodiments, when initially powered on via the on/off switch 35 base station 31 enters manual mode. In manual mode, strike sensors 1 and 2 record projectile or energy strikes by sending a signal to target control system 7. Target control system 7 records the strike and activates strike indicator LED 41 or another visual indicator. The system may also send an output to speaker 42 in the form of a recorded sound, tone, or pulse. Information identifying each projectile or energy strike will also be broadcast via transceiver 11 to base station 31, specifically to base station control system 32 through base station transceiver 33, and to any other compatible communication devices within range. Base station 31 may additionally be connected, either by hard wiring or via a wireless system, to a network, such a WiFi network, LAN, infrared network, or Bluetooth network, via base station transceiver 33 or another communications module to allow for listening and processing of hit information by multiple devices connected to the network.

Figure 10:
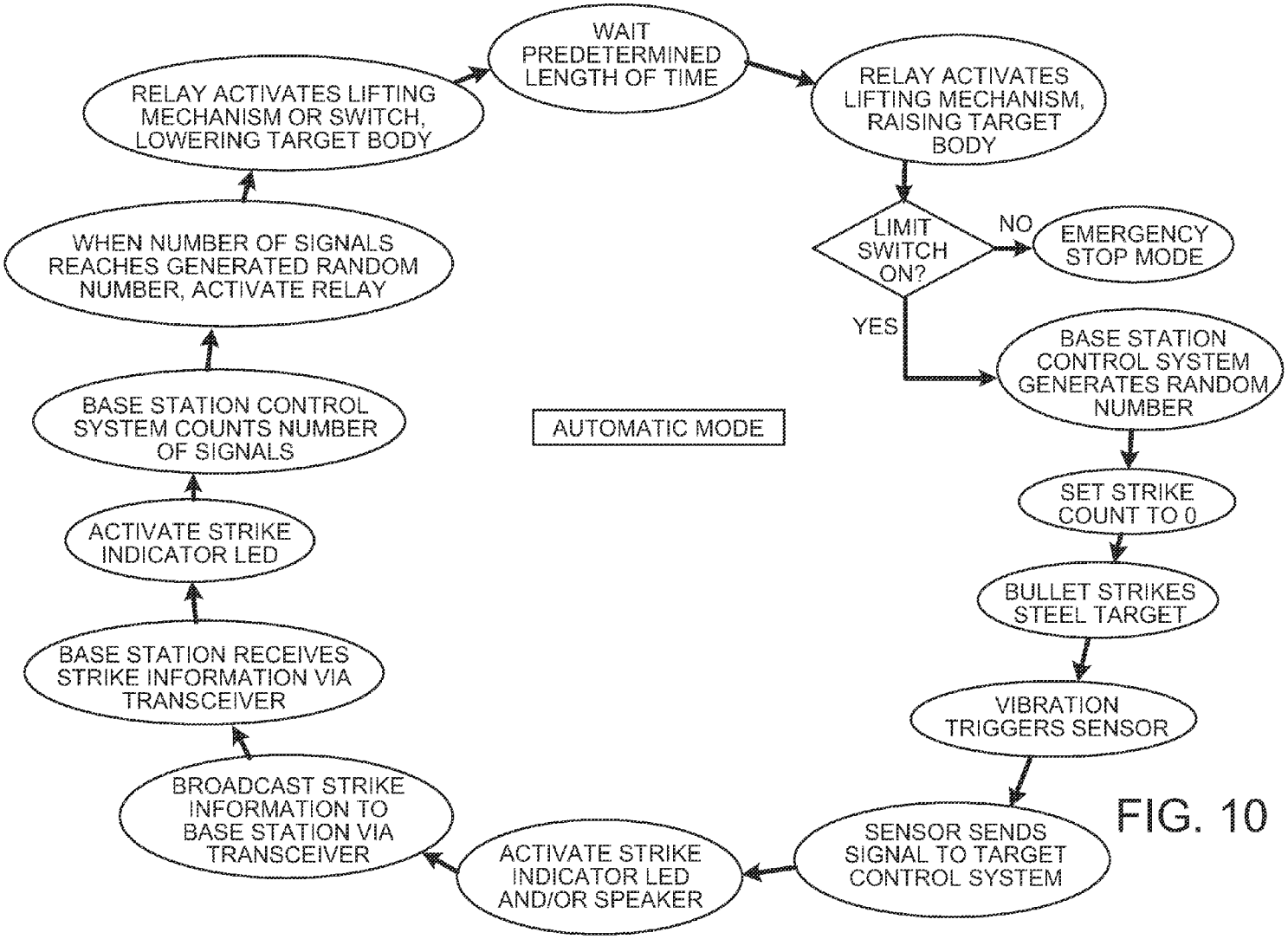
FIG. 10 is a flow chart depicting the sequential steps of the operation of the ballistic compliance target in an "automatic" embodiment.

Automatic mode can be selected by activating automatic switch 43. Referring to FIG. 10, in automatic mode the system first checks that limit switch 44 is activated, and the system subsequently operates in a loop. At the beginning of the loop base station control system processor 32 generates a random number and sets the strike count to 0. The system then begins counting projectile or energy strikes detected by strike sensors 1 and 2. Strike sensors 1 and 2 respond to a projectile or energy strike by sending a signal to target control system 7. Target control system 7 records the strike and illuminates strike indicator LED 41 or another visual indicator. The system may also send an output to the speaker output 42 in the form of a recorded sound, tone, or pulse. Information identifying each projectile or energy strike may also be broadcast on transceiver 11 to the base station 31 and to any other compatible communication devices within range. Base station 31 may additionally be connected, either by hard wiring or via a wireless system, to a network, such a WiFi network, LAN, infrared network, or Bluetooth network, via base station transceiver 33 or another communications module to allow for listening and processing of hit information by multiple devices connected to the network. When base station control system 32 receives information identifying a strike, the hit indicator LED 45 flashes and the strike count is increased by a number based upon the location of the originating strike sensor 1 or 2. If the strike count is greater than or equal to the random number generated at the beginning of the cycle, the base station control system 32 activates relay 46 which in turn activates either lift mechanism 34 or release mechanism 9 to drop the target body 5, for example by releasing or unwinding cable 14 from a spool or winch, such that target body 5 descends from its suspended position. After a predefined wait time, base station control system 32 activates relay 46 and the target body 20 is lifted back to the "upright" position by lift mechanism 34, for example by securing and winding cable 14 into a spool or winch, and the program loop starts over.

The position of target body 5 and the operation mode of the base station can be further changed by activation of up button 49 or down button 50. If up button 49 is pressed, the base station control system 32 checks if limit switch 44 is active. If limit switch 44 is active, base station control system 32 changes the system mode to manual mode. If limit switch 44 is not active, the base station control system 32 activates relay 46 which turns on lift mechanism 34 and raises target body 5 until it reaches the upright position, and activates limit switch 44. As soon as limit switch 44 is activated, base station control system 32 turns off the relay 46, stopping lift mechanism 34.

If down button 50 is pressed, the base station control system 32 changes the system mode to manual mode. The base station control system 32 activates the relay 46, which turns on the lift mechanism 34 or release mechanism 9, and lowers the target body 5. This switch is momentary and the relay 46 will remain active as long as the switch is pressed.

If the auto switch 43 is pressed, the base station control system 32 checks if the limit switch 44 is on. If limit switch 44 is active, the base station control system 32 changes the system mode to automatic mode. If the limit switch 44 is not active then the base station control system 32 will change the system mode to emergency stop mode.

Whenever the mode is changed, information indicating the mode change is transmitted from the base station control system 32 to the target control system 7 through transceivers 11 and 33. As a failsafe, the base station control system 32 verifies the operation mode of the target control system 7 at the beginning of each software loop, and synchronizes the operation mode if necessary.

The base station 31 may enter a low power sleep mode when no command is entered and no hit is detected for a predetermined amount of time. Any command sent to the base station control system 32 will awaken the system from sleep mode. When the base station 31 is awakened from sleep, it resumes its last mode of operation unless the on/off switch 35 was previously turned off. If the on/off switch 35 was previously turned off and the base station 31 is awakened from sleep, the base station 31 defaults to manual mode.

In some embodiments, the base station 31 or target control system 7 may check for specific safety criteria prior to operation. The system may check for the presence of a physical or electronic authorization key in safety key slot 47, the activation of a safety switch 48, or presence of another indicator to determine that the system may safely operate. If these criteria are not met, emergency stop LED 39 may be lit, and the system may ignore user commands until the safety criteria are satisfied.

Figure 11:
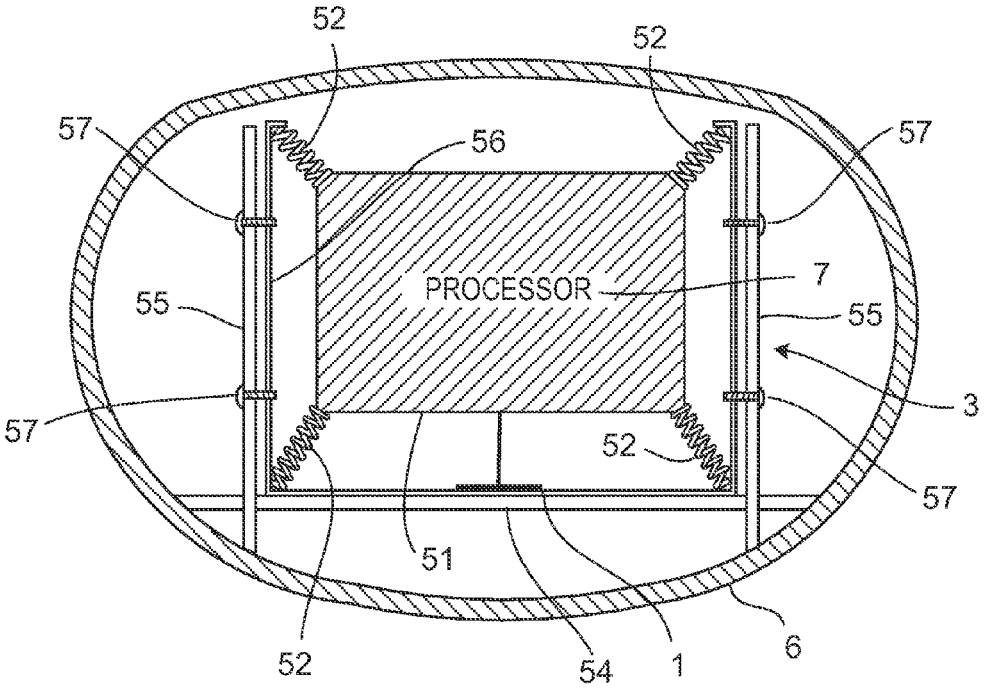
FIG. 11 is a cut-away top view of the arrangement for mounting the controller in the COM container of the target body and also depicts the placement of the sensor for the COM container.

The target control system 7, transceiver 11, and random number generator 12 may be housed in separate containers but are preferably positioned inside COM container 3 as shown in FIG. 11. The housing 51 for target control system 7 is suspended by shock absorbing supports 52 such as, for example, elastic cords, springs, or pneumatic devices within COM container 3 which is in turn mounted within the target body 5.

The outer skin 6 of target body 5 is formed of a semi-rigid material that can be shaped or molded into a generally human form in order to simulate the shape of an armed assailant. Preferably the material used for skin 6 is selected to be capable of preventing ricochet or bullet fragment ricochet of projectiles that strike the COM container 3 or the head container 4. Suitable materials for skin 6 include by way of non-limiting example, heavy duty rubber, paper laminates, paper, rubber or fabric laminates with metal wire or mesh, or Kevlar fabric. In an especially preferred embodiment the skin 6 is between about 0.25 to about 0.375 inches thick and made of rubber laminated with a woven textile material such as Kevlar. To assist in preventing ricochets, the skin is intentionally spaced apart from the metal components (e.g., COM bod 3 and head container 4). In this embodiment the skin 6 is self-sealing and closes behind any projectile strike that penetrates the skin.

Figure 12:
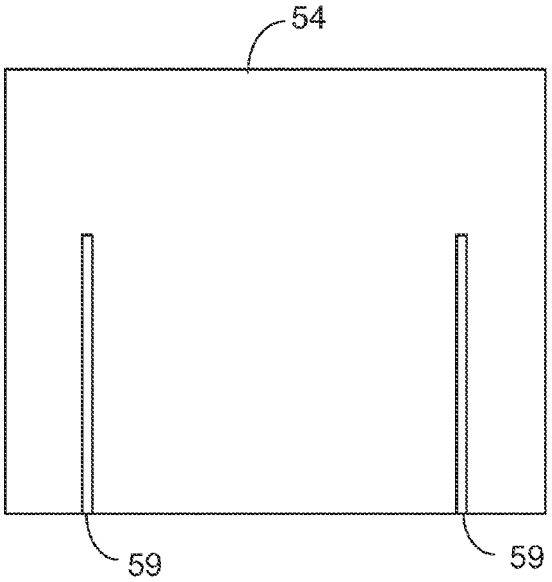
FIG. 12 illustrates a typical front (or rear) panel of the COM container in which the controller is mounted.

Target body 5 includes container 4 which is intended to simulate the head of the target body 5, and a COM container 3 that represents the COM of the target. Container 3 and head container 4 are joined by a connector portion 53 which may include a sensor used to simulate a spinal hit. In some embodiments, the target body components 3, 4 and 53 are made of steel plates. In one preferred embodiment components 3, 4 and 53 are made of steel covered by interlocking plates of AR500 steel plate. COM Container 3 is covered by individual steel plates (as illustrated in FIGS. 11-13) that include a front panel 54 and side panels 55 that are bolted to the underlying steel body 56 by bolts 57, and may include a rear panel (not shown) which is identical to the front panel.

Figure 13:
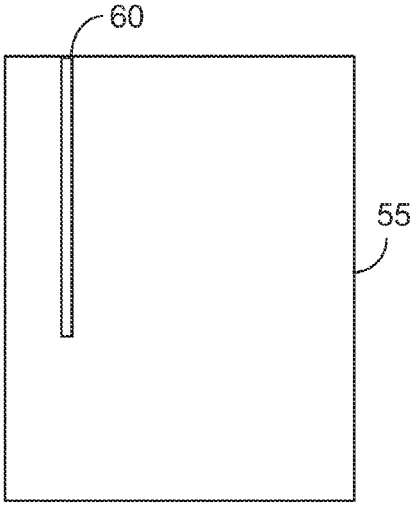
FIG. 13 illustrates the side panel of the COM container depicted in FIG. 12.

The sides of the containers 3 and 4 are formed from identical steel plates 55 as illustrated in FIG. 13. Plate 54 is fitted with longitudinal slots 59 that engage with slot 60 on the respective side plates 55. In some embodiments, the rear panel (not shown) of COM container 3 can be eliminated in order to reduce weight, construction expense, and transceiver signal attenuation. After the slots 59 and 60 are fitted to one another, the plates 54 and 55 form the front and sides of COM container 3, and can be joined by any appropriate means including for example welding the plates together along the slots 59 and 60. If the COM container 3 is constructed with a rear panel, this panel can also be fastened to the side panels by welding or other suitable means. The head container 4 is constructed in the same fashion with smaller steel panels. COM container 3 and head container 4 may also be made of another material, such as a woven fiber, iron, or any other projectile-resistant materials.

In one preferred embodiment, one of sensors 1 and 2 is usually positioned on the interior of COM container 3 and the other on the interior of head container 4. In some embodiments, sensors 1 and 2 not only have the ability to detect hits (projectile strikes in the vicinity of the sensor), but can also measure the force of the impact of the projectile against the wall of containers 3 or 4 and transmit this information to target control system 7 or if so configured, base station control system 32. This information is processed in target control system 7 or the base station control system 32, which assigns a weight (score) to each impact by a projectile. A projectile strike in the "head" (container 4) may be assigned a higher weight than a strike on the connector portion 53 or the COM container 3 (which represents the COM of the target). A strike to the COM container 3 will be accorded a greater weight than a strike in the connector portion 53. The target control system 7 or the base station control system 32 integrates information from sensors 1 and 2 on the number of strikes and the weight accorded to each strike, and uses this information to determine whether the number set generated by the random number generator 12 has been reached. For example, using the differential weighting arrangement, a heavily weighted strike on head container 4 representing the head of the target may be equal to or greater than the combined weight accorded to several strikes in the COM container 3.

Referring to FIGS. 2-4 it can be seen that the target body 5 is suspended from an adjustable height target support frame 15 by cable 14 which runs through the skin 6 at the top of the target body 5 and down into the head container 4. Cable 14 is attached via loop 17 to tapered pin 16. The target body 5 includes an outer top portion 61 that simulates the head of an armed assailant. In a preferred embodiment, the outer skin 6 of target body 5 is formed with a slit 62 on either side of the interior of skin 6.

As illustrated in FIG. 11, the target control system 7 is preferably positioned within the COM container 3 to provide it with the greatest protection from damage due to projectile strikes and shock.

The portions of the skin 6 separated by slit 62 are joined by a detachable fastening device 63 which can consist of Velcro fasteners, rubber extension collars fastened with mechanical snaps, zippers, buttons, adhesives, or a conventional belt/buckle arrangement. Use of these fasteners facilitates removal and replacement of the skin 6 after it has become worn out from internal ricochets and projectile strikes during use of the ballistic target of the present invention. Ricochet control can be especially important in shooting houses where teams of shooters are entering the room in a spread out configuration and team members are firing at the same target simultaneously. To reduce ricochets, the steel structure including the head container 4, connector 53 and COM container 3, as well as the target support frame 15 can also be configured (shaped) to assist in reducing ricochet of projectiles that strike the target.

The target body of the present invention is more realistic than conventional targets as it has a three dimensional generally human form that can move and twist in response to projectile strikes on the target. The target of the invention emphasizes accuracy as it scores only hits in the head container 4 (that simulates the head of the target) and the COM container 3 based on the placement of sensors 1 and 2. In different embodiments, the sensors can be placed in different locations on the target body. This can be of value if the shooter is being trained to aim for the targets arm or leg. In other embodiments, the target may be of a non-human form, such as of the form of an animal, vehicle, structure, or other form for use in other training exercises.

Another advantage of the target of the present invention is that the ability to differentially score each target site and in some embodiments the intensity of the hit. Generation of a random number of hits to trigger release of the target prevents patterning of shooting (i.e. training to always fire only 2 or 3 shots in each practice round). As a result, the number of shots it will take to cause the target to fall from the suspension is unpredictable and more realistically emulates real life situations. Because the target is in modular form, each component can readily be replaced without having to purchase a complete new target system. Also, since the target is life size and has an external skin that obscures the actual target, the shooting trainee is compelled to look at the anatomy of the target rather than a pattern of rings on a 2 dimensional target presentation.

The intelligent target of the present invention is of particular value in providing life-like target shooting practice for use in competitive sports shooting, e.g. with pistols, or in training military and law enforcement personnel who frequently are involved in live fire encounters with armed adversaries.

What is claimed is:

1. An intelligent target comprising a target body suspended from a support structure;

at least one sensor affixed to the target body that detects a hit in an area of the target body;

a controller, in communication with each sensor, that records the hits detected by the sensor and the area of the target body that was hit and issues a release command when a predetermined number of hits has been reached;

a release mechanism operatively connected with the controller and which releases the target body and allows the body to fall from the support structure on receipt of the release command from the controller and, wherein the controller includes a random number generator.

2. The intelligent target of claim 1 wherein the random number generator sets the number of hits required before a release command is sent to the release mechanism.

3. The intelligent target of claim 2 wherein the target body includes a main COM container located in the vicinity of the center of mass, a head container at the upper end of the target body, and a connector joining the main container and the head container.

4. The intelligent target of claim 3 wherein the controller resets to require a different number of impacts than for the prior release of the target before sending a release command to the release mechanism.

5. The intelligent target of claim 2 wherein at least one of the sensors is located within the main container.

6. The intelligent target of claim 5 wherein at least one of the sensors is located within the head container.

7. The intelligent target of claim 6 wherein the COM container and the head container are substantially surrounded by a skin in the shape of a human form.

8. The intelligent target of claim 7 wherein the skin includes a COM area and a head portion.

9. The intelligent target of claim 8 wherein the skin is slit at the sides.

10. The intelligent target of claim 2 wherein at least one sensor is located on the exterior of the target body.

11. The intelligent target of claim 10 wherein the exterior body sensor comprises a light detecting device.

12. The intelligent target of claim 11 wherein the light detecting device responds to light from a laser.

13. The intelligent target of claim 12 wherein the exterior body sensor is mounted on the exterior of the target body in the vicinity of the COM.

14. The intelligent target of claim 1 further comprising a transceiver configured to broadcast over a communications network information describing a hit detected by the sensor.

15. The intelligent target of claim 14 wherein the communications network is a LAN, WiFi network, Bluetooth network, infrared network, cellular telephone network, or another such network.

16. The intelligent target of claim 1 further comprising a light emitting diode wherein the light emitting diode is illuminated in response to a sensor detecting a hit.

17. The intelligent target of claim 1 further comprising a speaker wherein the speaker plays an auditory alert in response to a sensor detecting a hit.

18. The intelligent target of claim 1 wherein the controller is set to release the target body after reaching a predetermined scoring weight.

19. The intelligent target of claim 1 comprising at least two sensors, each of said sensors located on a different area of the target body and having a different scoring weight.

20. The intelligent target of claim 1 which comprises a lift mechanism operatively connected with the controller and which lifts the target body to a suspended position from the support structure on receipt of a lift command from the controller.

21. A method for using an intelligent target comprising:

Positioning a target body on a target support frame in a suspended position;

Providing one or more hit sensors on the target body;

Detecting hits to the target body through the one or more hit sensors;

Counting the number of hits detected by each of the one or more sensors and

Dropping the target body from the suspended position after the counted number of hits is equal to or exceeds a predetermined number that is randomly generated.

22. The method of claim 21, further comprising lifting the target body back to the suspended position after a predetermined length of time after the target body was dropped.

23. The method of claim 21 which comprises assigning a different scoring weight to each of the sensors to be scored when the sensor is hit.

24. An intelligent target comprising a target body suspended from a support structure;

at least two sensors affixed to the target body, each of the sensors being affixed to a different location on the target body and each having a predetermined scoring weight when the sensor detects a hit;

a random number generator that generates a random hit score, a controller in communication with each sensor, that records the hits detected by the sensor, computes the scoring weight of each hit and issues a release command that releases the target body from the support structure when the random hit score is detected by the controller.

25. The intelligent target of claim 24 wherein at least one of the sensors is located in the head area of the target body.

26. The intelligent target of claim 24 wherein one of the sensors has a different scoring weight than the other sensors.

27. The intelligent target of claim 24 wherein each sensor has a specific scoring weight and the controller integrates information on the number of hits and a scoring weight accorded to each hit.

* * * * *